US008196326B2

(12) United States Patent
Frey

(10) Patent No.: US 8,196,326 B2
(45) Date of Patent: Jun. 12, 2012

(54) MULTI-FRAME GROOVE-MOUNT WALL SYSTEM

(75) Inventor: Robert M. Frey, Salt Lake City, UT (US)

(73) Assignee: Moss, Inc., Salt Lake City, UT (US)

( * ) Notice: Subject to any disclaimer, the term of this patent is extended or adjusted under 35 U.S.C. 154(b) by 203 days.

(21) Appl. No.: 12/854,147

(22) Filed: Aug. 10, 2010

(65) Prior Publication Data

US 2012/0036755 A1 Feb. 16, 2012

(51) Int. Cl.
*A47G 1/06* (2006.01)

(52) U.S. Cl. ..... 40/729; 160/354

(58) Field of Classification Search ..... 49/475.1, 49/489.1; 160/369, 371, 327, 328, 392, 395; 38/102.91; 40/729, 790, 782, 792
See application file for complete search history.

(56) References Cited

U.S. PATENT DOCUMENTS

| | | | | |
|---|---|---|---|---|
| 2,601,734 A | | 7/1952 | Couzinet | |
| 3,200,526 A | * | 8/1965 | Munn | 40/791 |
| 3,255,810 A | | 6/1966 | Rowbottam | |
| 3,731,413 A | * | 5/1973 | Hooper, Jr. | 40/765 |
| 4,233,765 A | | 11/1980 | O'Mullan et al. | |
| 4,884,353 A | * | 12/1989 | Taylor | 40/611.01 |
| 6,263,604 B1 | * | 7/2001 | Williams | 40/718 |
| 7,363,739 B2 | * | 4/2008 | Dalsey et al. | 40/729 |
| 2006/0042141 A1 | | 3/2006 | Hansen et al. | |
| 2009/0049727 A1 | * | 2/2009 | Vincent | 40/730 |
| 2010/0202827 A1 | | 8/2010 | Frey | |

* cited by examiner

*Primary Examiner* — Joanne Silbermann
*Assistant Examiner* — Shin Kim
(74) *Attorney, Agent, or Firm* — Lance M. Pritikin

(57) ABSTRACT

A multi-frame groove-mount wall system comprises a multiplicity of closed frame sections and a panel element. Each closed frame section has a frame opening and a plurality of interconnected frame members, each with a groove segment. The closed frame sections can be releasably coupled to form a multi-frame structure having an outer perimeter. The panel element has a flexible substrate portion, a periphery and a multiplicity of edge gasket segments disposed about the periphery. The panel element can be removably and tensionally affixed to the multi-frame structure such that the substrate portion is simultaneously disposed across the frame opening of each closed frame section by interengagement between a plurality of the edge gasket segments and a plurality of the groove segments that are proximate the outer perimeter, and none of the edge gasket segments are shared between a groove segment of one closed frame sections and a groove segment of another closed frame section.

20 Claims, 5 Drawing Sheets

MULTI-FRAME GROOVE-MOUNT WALL SYSTEM

TECHNICAL FIELD

The present invention relates generally to the field of portable static display systems. More particularly, the invention concerns portable static display systems comprising a segmented framework to which flexible display panels are attached, such as those commonly used for decoration and advertising in retail establishments, trade shows, and the like.

BACKGROUND OF THE INVENTION

Frame and panel interface systems are commonly used to construct displays in homes, museums, retail stores, airport terminals, trade show exhibits and the like. Some of these systems are made up of standard-sized frame units configured to releasably support a flexible display substrate in tension by way of engagement between a continuous closed-loop groove running along the periphery of the frame unit, and gaskets disposed along the periphery of the display substrate. These wall systems may be referred to as "groove-mount" wall systems, and are frequently used in the trade show and retail environment due to their relative light weight, low cost and portability.

An advantage of producing wall frame units in standard sizes is that they can be manufactured in volume, resulting in economies of scale which benefit the manufacturer and purchaser alike. It is frequently desirable to create larger displays by joining multiple standard-sized wall systems together. It is important in the art that, regardless of the nature and organization of its supporting framework, the entire display wall remains visually appealing and not present features which might distract the attention of prospective customers away from the information and designs being displayed. Exposed framework and discontinuities within the wall surface or graphic design are examples of such potentially distracting features.

In a typical groove-mount frame unit, the linear segments of the continuous closed-loop groove effectively terminate within the periphery of the frame unit. Consequently, in conventional groove-mount style wall systems, the size and shape of the flexible display substrate has historically been closely matched to the outer dimensions of an individual frame unit to which it is designed to be attached. Joining such frame units together therefore commonly results in a larger wall system which presents the appearance multiple substrates arranged in series, with portions of the frame structure being visibly exposed therebetween. The resulting segmented appearance of the wall surface and any graphic design printed thereon are examples of the kind of distracting features which are known to be undesirable in the art.

Those in the art have long recognized the need for an improved, low-cost, portable display wall system which leverages the use of multiple standard-sized frame units designed to support flexible display substrates, while presenting the appearance of a larger, custom, smooth and continuous display wall surface.

SUMMARY OF THE INVENTION

The shortcomings of the prior art are overcome and additional advantages are provided by a multi-frame groove-mount wall system comprising a multiplicity of closed frame sections and a panel element.

Each of the closed frame sections has a plurality of frame members, typically three or more in number, disposed about a frame axis in interconnected fashion. The frame members are typically made substantially of an extruded metal, such as aluminum. Each of the closed frame sections has a frame opening. Each of the frame members is elongated and has a groove segment that opens generally parallel to its respective frame axis. Each of the groove segments is typically substantially linear. The frame members each generally include an outer groove wall. The outer groove wall of each of the frame members generally longitudinally terminates the groove segment of the adjacent frame members of the same closed frame section. The closed frame sections are configured to be releasably coupled to one another to form a multi-frame structure having an outer perimeter.

The panel element has a substrate portion, a periphery and a multiplicity of edge gasket segments disposed about the periphery. The substrate portion is flexible and typically made substantially of a textile. The panel element is configured to be removably and tensionally affixed to the multi-frame structure such that the substrate portion is simultaneously disposed across the frame opening of each of the closed frame sections by interengagement between a plurality of the edge gasket segments and a plurality of the groove segments that are proximate the outer perimeter, and none of the edge gasket segments are shared between one of the groove segments of one of the closed frame sections and one of the groove segments of another of the closed frame sections.

In embodiments, the closed frame sections are releasably and rigidly coupled in generally planar fashion or generally angular fashion. Embodiments may also comprise one or more intermediate members, such as accessory columns or corner columns. Each intermediate member is configured to be disposed substantially between two of the closed frame sections of the multi-frame structure.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
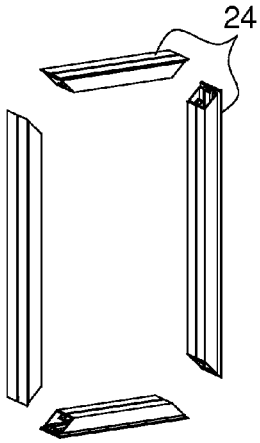
FIG. 1 is an exploded view of an embodiment of a closed frame section, showing the respective frame members.
Figure 2:
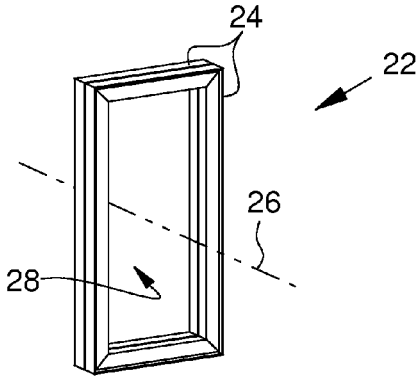
FIG. 2 is a perspective view of the closed frame section of FIG. 1, showing the respective frame members interconnected.

Referring now to the drawings, like reference numerals designate identical or corresponding features throughout the several views.

Throughout the several figures, embodiments of a multi-frame groove-mount wall system are shown generally at 20, and typically comprise a multiplicity of closed frame sections 22 and a panel element 34. Referring to FIGS. 1-5 for illustration, each of the closed frame sections 22 have a plurality of frame members (shown, for example, at 24) disposed about a frame axis 26. The frame members 24 of each of the closed frame sections 22 are interconnected. Each of the closed frame sections 22 further has a frame opening 28. Each of the frame members 24 are elongated and have a groove segment 30 that opens generally parallel to the respective frame axis 26. The closed frame sections 22 are configured to be releasably coupled to one another to form a multi-frame structure 32 having an outer perimeter (shown, for example, generally at 42).

Figure 4:
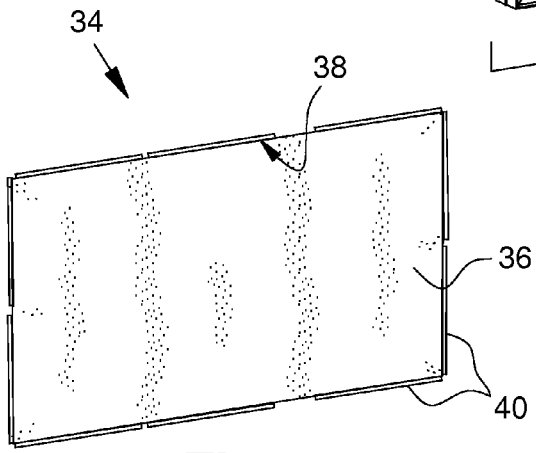
FIG. 4 is a perspective view of an embodiment of a panel element, including a substrate portion and a multiplicity of edge gasket segments.
Figure 15:
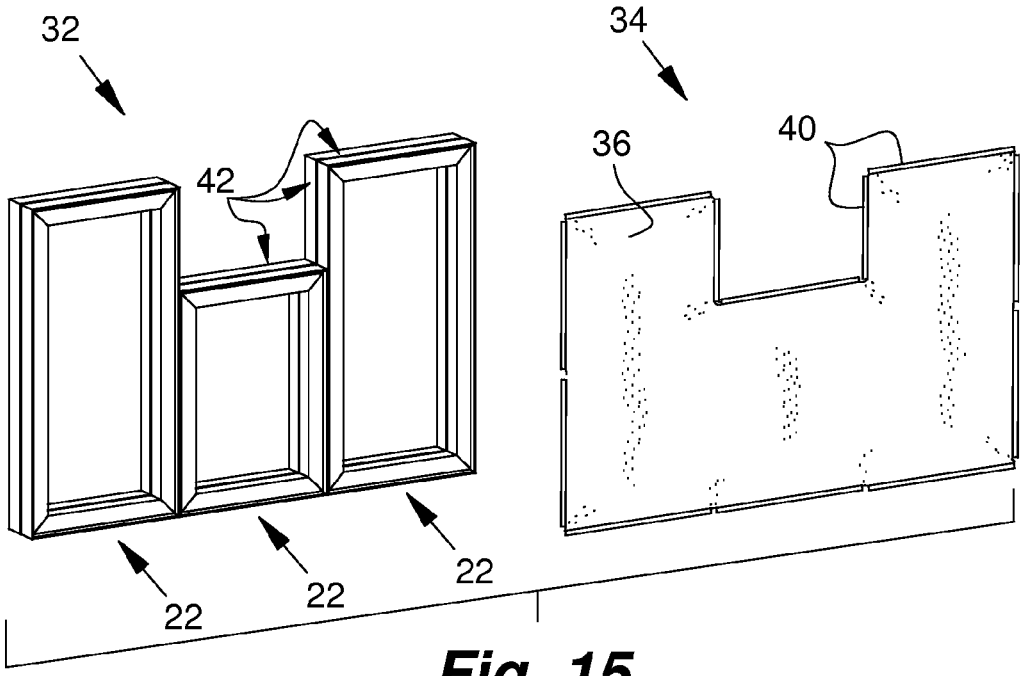
FIG. 15 is a perspective view of a further embodiment of a multi-frame groove-mount wall system, in which the closed frame sections are of varying sizes and the panel element is shown detached from the respective multi-frame structure.

Referring to FIGS. 4 and 15 for illustration, the panel element 34 has a substrate portion 36, a periphery (shown, for example, generally at 38) and a multiplicity of edge gasket segments (shown, for example, at 40) disposed about the periphery 38. The substrate portion 36 is flexible, and may be stretchable as well. Referring to FIGS. 8-12 for illustration, the panel element 34 is configured to be removably and tensionally affixed to the multi-frame structure 32 such that the substrate portion 36 is simultaneously disposed across the frame opening 28 of each of the closed frame sections 22 by interengagement between a plurality of the edge gasket segments 40 and a plurality of the groove segments 30 that are proximate the outer perimeter 42, and none of the edge gasket segments 40 are shared between one of the groove segments 30 of one of the closed frame sections 22 and one of the groove segments 30 of another of the closed frame sections 22. This is principally due to the fact that appropriately positioned gaps 48 or equivalent relief features located between adjacent edge gasket segments 40 allow the substrate portion 36 to smoothly span or stretch across frame features, such as intermediate members 44 or outer groove walls 52, which lack their own groove segments or which otherwise disrupt communication between aligned groove segments 30 of adjacent closed frame sections 22.

Figure 5:
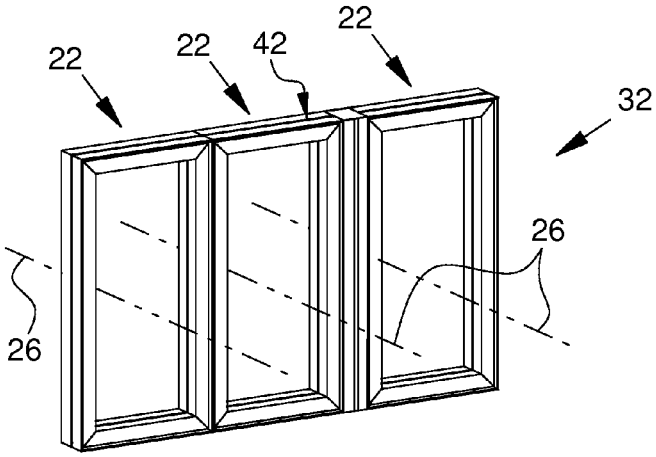
FIG. 5 is a perspective view of the multi-frame structure of FIG. 3, in which the closed frame sections are coupled.
Figure 13:
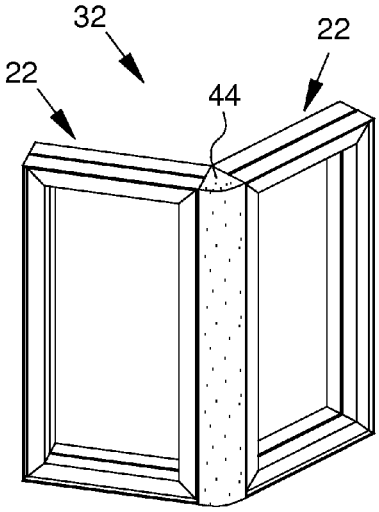
FIG. 13 is a perspective view of an embodiment of a multi-frame structure in which the respective closed frame sections are shown coupled in generally angular fashion, and an intermediate member in the form of a corner column is shown disposed substantially between respective closed frame sections.
Figure 14:
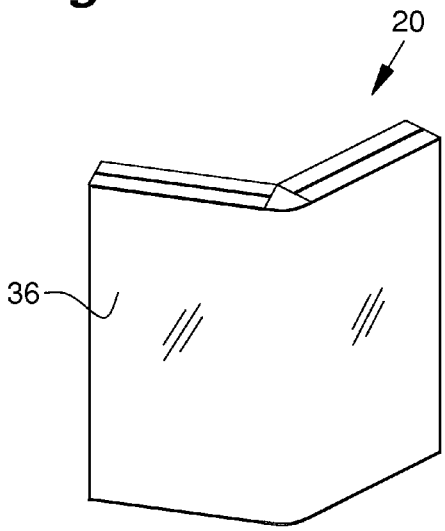
FIG. 14 is a perspective view of an embodiment of a multi-frame groove-mount wall system in which a panel element is tensionally affixed to the multi-frame structure shown in FIG. 13.

In certain embodiments, the closed frame sections 22 are configured to be releasably and rigidly coupled to one another, typically by way of conventional joining hardware. FIG. 5 illustrates, for example, closed frame sections 22 releasably and rigidly coupled in generally planar fashion. FIG. 13 illustrates closed frame sections 22 releasably and rigidly coupled in generally angular fashion.

Figure 16:
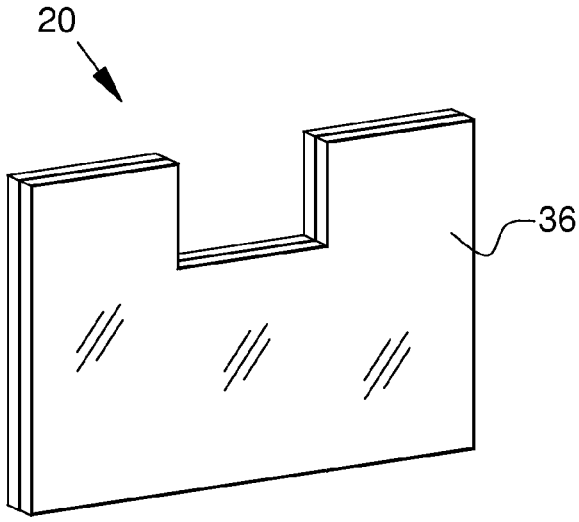
FIG. 16 is a perspective view of the embodiment shown in FIG. 15, but in which the panel element is shown tensionally affixed to the respective multi-frame structure.

In the embodiments shown throughout the several figures, each closed frame section 22 has four frame members 24. However, depending on the particular embodiment, closed frame sections 22 may each have three or more frame members 24, allowing the individual closed frame sections 22 to generally form any polygonal shape, symmetrical or otherwise. It is further understood that one or more frame members 24 of certain embodiments may be curved. In general, as illustrated for example in FIGS. 15 and 16, the closed frame sections 22 of each embodiment will be shaped and sized to facilitate their coupling to one another as well as their ability to tensionally support a panel element 34 of a particular desired shape.

In embodiments, frame members 24 may be made substantially of an extruded metal, such as, for example, an extruded aluminum. Such extrusions are typically hollow, to produce a sufficiently strong, but lighter-weight and more cost-effective framework. As illustrated for example in FIGS. 8 and 10, frame members 24 may also be formed to include additional channel and groove features to which additional hardware and panels may be removably attached. The frame members 24 of each of the closed frame sections 22 may be interconnected, for example, by welds, conventional joining hardware or an appropriate adhesive.

Figure 3:
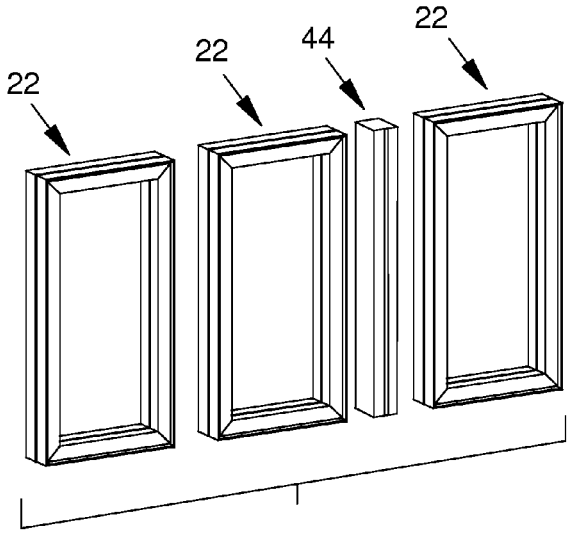
FIG. 3 is an exploded view of an embodiment of a multi-frame structure.
Figure 6:
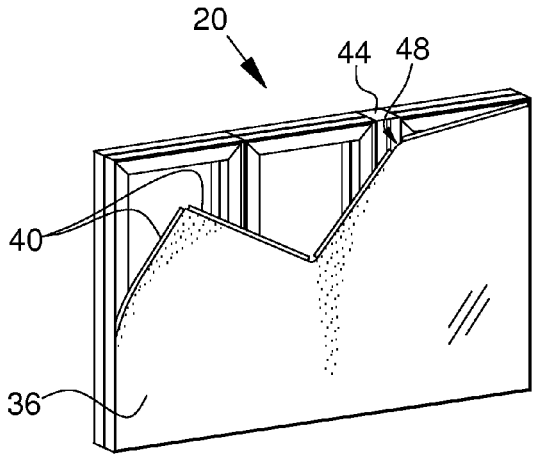
FIG. 6 is a perspective view of an embodiment of a multi-frame groove-mount wall system, showing a panel element partially tensionally affixed to a multi-frame structure.
Figure 7:
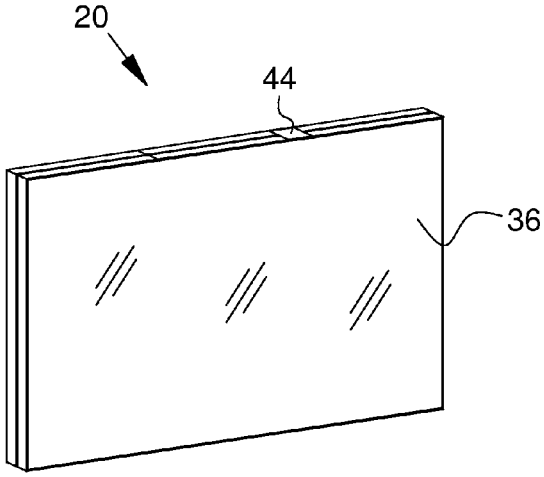
FIG. 7 is a perspective view of an embodiment of a multi-frame groove-mount wall system, showing a panel element tensionally affixed to a multi-frame structure.

Referring to FIGS. 3 and 13 for illustration, particular embodiments of a multi-frame groove-mount wall system 20 further comprise an intermediate member 44 configured to be disposed substantially between two or more of the closed frame sections 22 of the multi-frame structure 32. Intermediate members 44 may be oriented in various ways, for example, vertically or horizontally, depending on the particular embodiment. Such intermediate members 44 may take the form of, for example, accessory columns (as illustrated in FIG. 3), corner columns (as illustrated in FIG. 13), or other elements that may be attached between wall system hardware or frame segments. In each such case, as illustrated for example in FIGS. 6 and 7, a respective gap 48 between adjacent edge gasket segments 40 allows the substrate portion 36 to smoothly span across the intermediate member 44 without the need for the intermediate member 44 to have a groove segment 30 to accommodate an edge gasket segment 40, and without resulting in the exposure of unsightly structural features.

Figure 12:
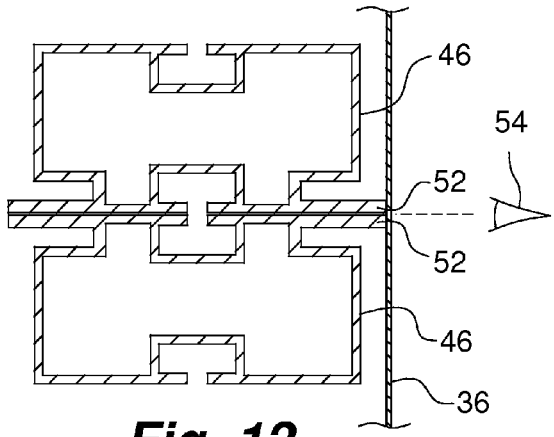
FIG. 12 is a cross-sectional view taken along line 12-12 of FIG. 9.

Referring to FIG. 12 for illustration, in certain embodiments the substrate portion 36 may be made substantially of a textile. Further, the substrate portion 36 of embodiments may be, for example, white, dyed solid colors or feature custom printing viewable from an external viewpoint 54. Substrate portion 36 may also include one or more light-blocking layers to minimize frame element shadowing and enhance the continuous look of the substrate portion 36 from an external viewpoint 54. It is understood that the substrate portion 36 in certain embodiments may not completely cover one or more of the frame openings 28, for example, where an aperture in the substrate portion 36 is desired for ornamental or functional purposes.

Figure 8:
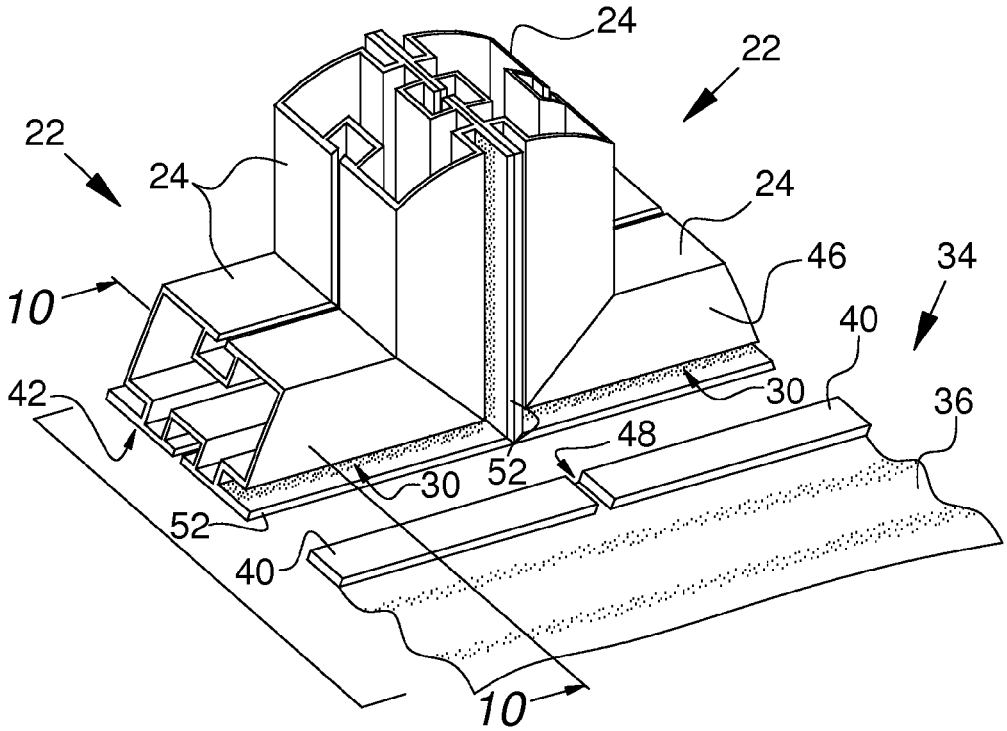
FIG. 8 is a broken perspective view of an embodiment of a multi-frame groove-mount wall system, in which the panel element is shown not yet tensionally affixed to the multi-frame structure, and edge gasket segments are shown out of interengagement with respective groove segments.
Figure 9:
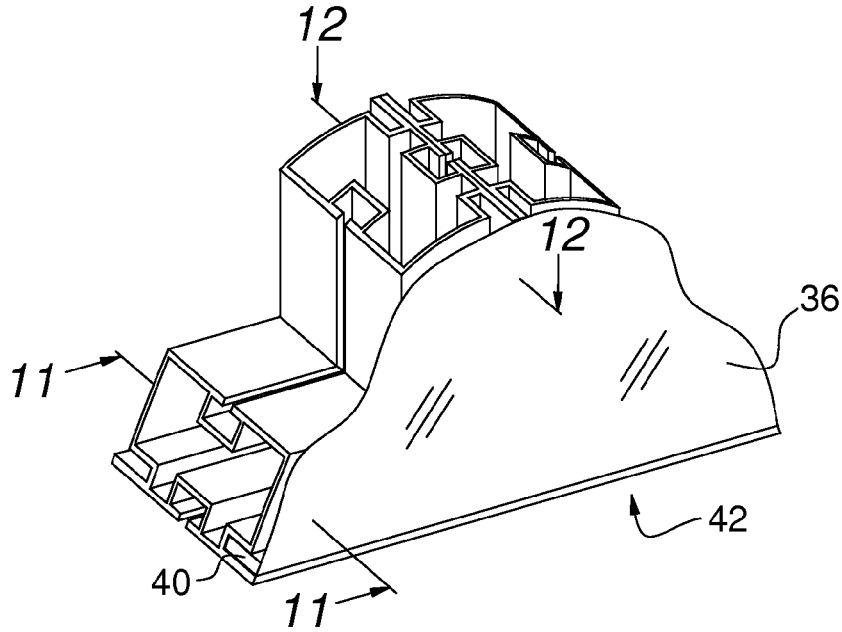
FIG. 9 is a broken perspective view of the embodiment of FIG. 8, but in which the panel element is shown tensionally affixed to the multi-frame structure, and edge gasket segments are shown in interengagement with respective groove segments.
Figure 10:
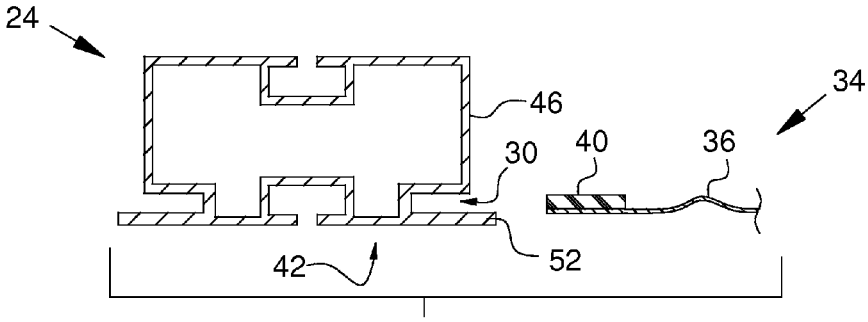
FIG. 10 is a cross-sectional view taken along line 10-10 of FIG. 8.
Figure 11:
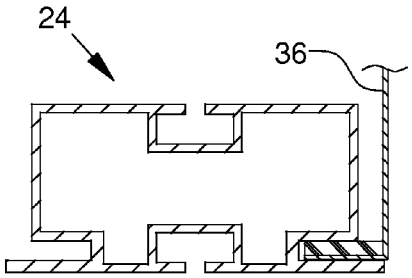
FIG. 11 is a cross-sectional view taken along line 11-11 of FIG. 9.

In certain embodiments, the length of each of the edge gasket segments 40 is approximately equal to the length of a respective one of the groove segments 30 that are proximate the outer perimeter 42. In embodiments, the groove segments 30 of the frame members 24 of each of the closed frame sections 22 collectively form a perimeter groove within their respective closed frame section 22, each perimeter groove being substantially continuous. As illustrated in FIG. 8, the closed-loop nature of this perimeter groove generally disrupts linear communication between groove segments 30 belonging to two separate but adjacent closed frame sections 22, even if those groove segments 30 are in linear alignment with each other.

Referring to FIG. 8 for illustration, in embodiments, the frame members 24 each typically include an outer groove wall 52. The outer groove wall 52 of each of the frame members 24 generally longitudinally terminates the groove segment 30 of the adjacent frame members 24 of the same closed frame section 22. Further, in embodiments, each of the groove segments 30 is substantially linear. However, one or more groove segments 30 of particular embodiments may be curved to accommodate a panel element 34 with a curved edge gasket segment 40.

Referring again to FIG. 12 for illustration, in particular embodiments, each frame member 24 has a lateral face 46 which is generally normal to the frame axis 26 of the respective closed frame section 22, and at least one of the frame members 24 includes a strip of approximately white or light-colored material adhesively attached to its respective lateral face 46. This white or light-colored material can be used to help mask a dark frame member 24 which would otherwise be visually conspicuous from an external viewpoint 54 in embodiments where the substrate portion 36 is partially translucent or otherwise allows some light through.

In one preferred process for custom-designing a multi-frame groove-mount wall system 20 according to the present invention, the desired size and shape of the substrate portion 36 largely drive the design of the size and shape of the multi-frame structure 32. The size and shape of the multi-frame structure, along with cost and portability considerations, largely drive the selection of the number, size, shape and arrangement of each of the multiplicity of standard-sized closed frame sections 22. The resulting locations and lengths of the groove segments 30 proximate the outer perimeter 42 of the multi-frame structure 32 largely drive the placement locations and lengths of the edge gasket segments 40 and gaps 48 along the periphery 38 of the panel element 34. It is understood that the particular process and respective design drivers used to custom-design a multi-frame groove-mount wall system will vary depending on considerations such as the dimensions of the available display space, the preferences of the customer, and the immediate availability of certain standard-sized closed frame sections 22 and related hardware.

Once a custom panel element 34 has been manufactured, the manufacturer may sell it with instructions as to which standard-sized closed-frame sections 22 to acquire and how they should be arranged or coupled to support the panel element 34. Alternatively, the manufacture may package the panel element 34 along with the appropriate closed-frame sections 22, and the necessary hardware and instructions to complete the setup of the custom display solution.

As illustrated by way of the particular embodiments discussed herein, a multi-frame groove-mount wall system in accordance with the present invention provides a mechanism whereby a single flexible substrate with edge gasket segments around its periphery can cover multiple closed frame sections and still give the appearance of a larger continuous wall solution. This is achieved without each of the individual closed frame sections needing to be matched in size with a separate flexible substrate portion. This is particularly useful in the art because it allows the end-user to purchase or rent the lower-cost standard-sized groove-mount wall system frames, couple the frames together to form a custom-sized frame solution, and cover the resulting framework with one continuous substrate, thereby achieving the highly desirable appearance of a continuous wall surface much more cost-effectively.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A multi-frame groove-mount wall system comprising:

(a) a multiplicity of closed frame sections, each of the closed frame sections having a plurality of frame members disposed about a frame axis, the frame members of each of the closed frame sections being interconnected, each of the closed frame sections further having a frame opening, each of the frame members being elongated and having a groove segment that opens generally parallel to the respective frame axis, the closed frame sections being configured to be releasably coupled to one another to form a multi-frame structure having an outer perimeter; and (b) a panel element having a substrate portion, a periphery and a multiplicity of edge gasket segments disposed about the periphery, the substrate portion being flexible, the panel element being configured to be removably and tensionally affixed to the multi-frame structure such that:

(i) the substrate portion is simultaneously disposed across the frame opening of each of the closed frame sections by interengagement between a plurality of the edge gasket segments and a plurality of the groove segments that are proximate the outer perimeter; and (ii) none of the edge gasket segments are shared between one of the groove segments of one of the closed frame sections and one of the groove segments of another of the closed frame sections.

2. A multi-frame groove-mount wall system as defined in claim 1 in which the closed frame sections are releasably and rigidly coupled.

3. A multi-frame groove-mount wall system as defined in claim 1 in which the closed frame sections are releasably and rigidly coupled in generally planar fashion.

4. A multi-frame groove-mount wall system as defined in claim 1 in which the closed frame sections are releasably and rigidly coupled in generally angular fashion.

5. A multi-frame groove-mount wall system as defined in claim 1 in which the closed frame sections each have at least three frame members.

6. A multi-frame groove-mount wall system as defined in claim 1 in which the frame members are made substantially of extruded aluminum.

7. A multi-frame groove-mount wall system as defined in claim 1 in which the frame members of each of the closed frame sections are interconnected by welds.

8. A multi-frame groove-mount wall system as defined in claim 1 in which the substrate portion is made substantially of a textile.

9. A multi-frame groove-mount wall system as defined in claim 1 further comprising an intermediate member configured to be disposed substantially between two of the closed frame sections of the multi-frame structure.

10. A multi-frame groove-mount wall system as defined in claim 1 in which the substrate portion includes a light blocking layer.

11. A multi-frame groove-mount wall system as defined in claim 1 in which the length of each of the edge gasket segments is approximately equal to the length of a respective one of the groove segments that are proximate the outer perimeter.

12. A multi-frame groove-mount wall system as defined in claim 1 in which the groove segments of the frame members of each of the closed frame sections collectively form a perimeter groove within their respective closed frame section, each perimeter groove being substantially continuous.

13. A multi-frame groove-mount wall system as defined in claim 1 in which the frame members each include an outer groove wall, the outer groove wall of each of the frame members generally longitudinally terminating the groove segment of the adjacent frame members of the same closed frame section.

14. A multi-frame groove-mount wall system as defined in claim 1 in which each of the groove segments is substantially linear.

15. A multi-frame groove-mount wall system as defined in claim 1 in which each frame member has a lateral face, the lateral face being generally normal to the frame axis of the respective closed frame section, and at least one of the frame members includes a strip of approximately white or light-colored material adhesively attached to its respective lateral face.

16. A multi-frame groove-mount wall system comprising:

(a) a multiplicity of closed frame sections configured to be releasably and rigidly coupled to one another to form a multi-frame structure having an outer perimeter, each closed frame section having a plurality of frame members being disposed about a frame axis and being interconnected, each closed frame section further having a frame opening, each of the frame members:

(i) being made substantially of extruded aluminum;

(ii) having a groove segment that opens generally parallel to its respective frame axis; and (iii) including an outer groove wall, the outer groove wall of each frame member generally terminating the groove segment of the adjacent frame members of the same closed frame section, each of the groove segments being substantially linear; and (b) a panel element having a substrate portion, a periphery and a multiplicity of edge gasket segments disposed about the periphery, the substrate portion being made substantially of a textile and being flexible and stretchable, the panel element being configured to be removably and tensionally affixed to the multi-frame structure such that:

(i) the substrate portion is simultaneously disposed across the frame opening of each of the closed frame sections by interengagement between a plurality of the edge gasket segments and a plurality of the grooves that are proximate the outer perimeter; and (ii) none of the edge gasket segments are shared between one of the groove segments of one of the closed frame sections and one of the groove segments of another of the closed frame sections.

17. A multi-frame groove-mount wall system as defined in claim 16 in which the frame members each include an outer groove wall, the outer groove wall of each frame member generally longitudinally terminating the groove segment of the adjacent frame members of the same closed frame section.

18. A multi-frame groove-mount wall system as defined in claim 16 further comprising an intermediate member configured to be disposed substantially between two of the closed frame sections of the multi-frame structure.

19. A multi-frame groove-mount wall system as defined in claim 16 in which the frame members are made substantially of extruded aluminum, and the frame members of each of the closed frame section are interconnected by welds.

20. A multi-frame groove-mount wall system comprising:

(a) a multiplicity of closed frame sections releasably and rigidly coupled to one another to form a multi-frame structure having an outer perimeter, each closed frame section having a plurality of frame members being disposed about a frame axis and being interconnected, each closed frame section further having a frame opening, each of the frame members:

(i) being made substantially of extruded aluminum;

(ii) having a groove segment that opens generally parallel to its respective frame axis, the groove segment being substantially linear; and (iii) including an outer groove wall, the outer groove wall of each frame member generally terminating the groove segment of the adjacent frame members of the same closed frame section, each of the groove segments being substantially linear; and (b) a panel element having a substrate portion, a periphery and a multiplicity of edge gasket segments disposed about the periphery, the substrate portion being made substantially of a textile and being flexible and stretchable, the panel element being removably and tensionally affixed to the multi-frame structure such that:

(i) the substrate portion is simultaneously disposed across the frame opening of each of the closed frame sections by interengagement between a plurality of the edge gasket segments and a plurality of the grooves that are proximate the outer perimeter; and (ii) none of the edge gasket segments are shared between one of the groove segments of one of the closed frame sections and one of the groove segments of another of the closed frame sections.

* * * * *